United States Patent [19]

Fox et al.

[11] Patent Number: 4,556,167

[45] Date of Patent: Dec. 3, 1985

[54] VELCRO FASTENING ARRANGEMENT FOR RECLOSEABLE CARTON FLAPS

[75] Inventors: James D. Fox, Homewood; Bruce C. Beckway; Robert H. DeGroot, both of River Forest, all of Ill.

[73] Assignee: Packing Materials Corporation, Chicago, Ill.

[21] Appl. No.: 713,038

[22] Filed: Mar. 18, 1985

Related U.S. Application Data

[63] Continuation-in-part of Ser. No. 683,693, Dec. 19, 1984, abandoned.

[51] Int. Cl.[4] ..... B65D 45/00

[52] U.S. Cl. ..... 229/45 R; 24/442; 24/444; 229/37 R; 229/44 R

[58] Field of Search ..... 24/442–452, 24/306; 229/45 R, 37 R, 44 R; 224/901

[56] References Cited

U.S. PATENT DOCUMENTS

| | | | |
|---|---|---|---|
| 3,306,521 | 2/1967 | Giacovas | 229/45 R |
| 3,550,837 | 12/1970 | Erb | 229/45 R |
| 3,732,600 | 5/1973 | Perina | 24/444 |
| 3,951,332 | 4/1976 | Torbeck | 229/44 R |
| 4,034,909 | 7/1977 | Toda | 229/41 B |
| 4,333,602 | 6/1982 | Geschwender | 229/44 R |
| 4,403,366 | 9/1983 | Lucke | 24/442 |

FOREIGN PATENT DOCUMENTS

| | | | |
|---|---|---|---|
| 244226 | 4/1965 | Austria | 229/37 R |
| 1359799 | 3/1964 | France | 229/45 R |

*Primary Examiner*—William Price
*Assistant Examiner*—Gary E. Elkins
*Attorney, Agent, or Firm*—Robert E. Knechtel; Basil E. Demeur

[57] ABSTRACT

An improved transfer storage carton having complimentary fastening means affixed to each of the respective end flaps and to at least one of the top flaps which are folded in overlapped relationship atop the open compartment of the carton in conventional fashion to effectively close and seal the carton. In this respect, it is preferred to use complimentary fasteners of the type sold under the trademark "VELCRO" by Velcro Corp. The complimentary fasteners are fixed to and carried by clips which are generally u-shaped in configuration. These clips are extended through slots formed in the end and top flaps to secure the fasteners to the flaps. In addition, one side flap is formed to expose the complimentary fasteners secured to the end flaps when the side flap is folded to overlie the end flaps so that the complimentary fastener affixed to the other one of the side flaps automatically lockingly engage to seal shut the carton.

2 Claims, 7 Drawing Figures

VELCRO FASTENING ARRANGEMENT FOR RECLOSEABLE CARTON FLAPS

BACKGROUND OF THE INVENTION

This is a continuation-in-part of Ser. No. 683,693, filed Dec. 19, 1984, now abandoned. This invention relates generally to an improved carton and, in particular, to recloseable cartons of the transfer storage type.

Transfer storage cartons are well known and are used for storing files and the like. It is a requirement for these transfer storage cartons that they may be opened to retrieve a file and subsequently reclosed. One of the more popular types of transfer storage cartons have strings attached to at least one of the top flaps thereof which, after the top flaps are folded to close the opened top of the carton, are wrapped around buttonlike securement means attached to the side walls of the carton to secure the top flaps closed. To open the carton, the strings are simply unwrapped from around the securement means so that the top flaps can be opened.

Another requirement for the transfer storage cartons is that they can be opened and closed without mutilating in any way the cartons. While the string-type securement means described above are generally satisfactory in this respect, it is found on numerous occasions that the carton is inadvertently mutilated by those opening the carton neglecting to releaseably disengage the strings from the securement means on both sides of the carton so that upon opening the carton the carton at the point where the strings are fastened thereto are torn away from the carton. The buttom-type securement means likewise on many occasions are separated from the carton as a result of the same act on the part of the user, or as a result of stacking and moving the cartons about during the process of storing them.

In accordance with the present invention, an improved transfer storage carton is provided by affixing complimentary fastening means to each of the respective end flaps and to at least one of the top flaps which are folded in overlapped relationship atop the open compartment of the carton in conventional fashion to effectively close and seal the carton. In this respect, it is preferred to use complimentary fasteners of the type sold under the trademark "VELCRO" by Velcro Corp. Also, perferably and advantageously, the complimentary fasteners are fixed to and carried by clips which are generally u-shaped in configuration. These clips are extended through slots formed in the end and top flaps to secure the fasteners to the flaps. In addition, one side flap is formed to expose the complimentary fasteners secured to the end flaps when the side flap is folded to overlie the end flaps so that the complimentary fastener affixed to the other one of the side flaps automatically lockingly engage to seal shut the carton. With this construction, it is found that an upward force exerted upon the one side flap to open the carton results in a lever type action which causes a peeling action of the "VELCRO" fastener. Such a peeling action is necessary and desireable to permit the "VELCRO" fastener to be easily opened and to prevent the "VELCRO" fasteners from being inadvertently torn from the flaps to which they are secured. In addition by affixing the complimentary fasteners to the end flaps and to only one side flap, as opposed to affixing them to the respective side flaps, and forming the one side flap so that the fasteners affixed to the end flaps are exposed, eliminates the bulky bulge which normally is created at the top of the carton when it is closed and sealed, as in the case of the other existing cartons utilizing "VELCRO" fasteners. By eliminating this bulky bulge, the side flaps which are the last flaps to be closed, overlap one another and lie substantially flat atop one another. Accordingly, it is found that there is a far less tendency for the side flaps to snag with other cartons when they are stacked atop one another and that the cartons can be more easily stacked since they are seated essentially flat atop one another. This feature also relieves a great deal of the pressure exerted on the complimentary fasteners when the cartons are stacked atop one another, as opposed to the pressure exerted on the fasteners when they are affixed to the respective ones of the side flaps. Relieving the pressure in this fashion prevents the complimentary fasteners from being crushed, thus the useful life of the "VELCRO" fasteners and the carton both are extended. Furthermore, it prevents the fasteners from becoming so tightly locked together that it is extremely difficult to release them to open the carton, without tearing the fasteners from the carton or tearing the carton itself. When constructed in accordance with the invention, the side flaps can be opened without damaging the carton. The transfer storage cartons can be easily opened simply by lifting upwardly on the one side flap to peel loose the "VELCRO" fasteners, and subsequently opening the other flaps. The carton is reclosed simply by overlapping the end and side flaps to close the opened top of the carton and applying a sufficient downward force to again engage the complimentary "VELCRO" fasteners.

Accordingly, it is an object of the present invention to provide an improved recloseable carton and, in particular, an improved recloseable carton of the transfer storage type.

DESCRIPTION OF THE PREFERRED EMBODIMENT

Figure 1:
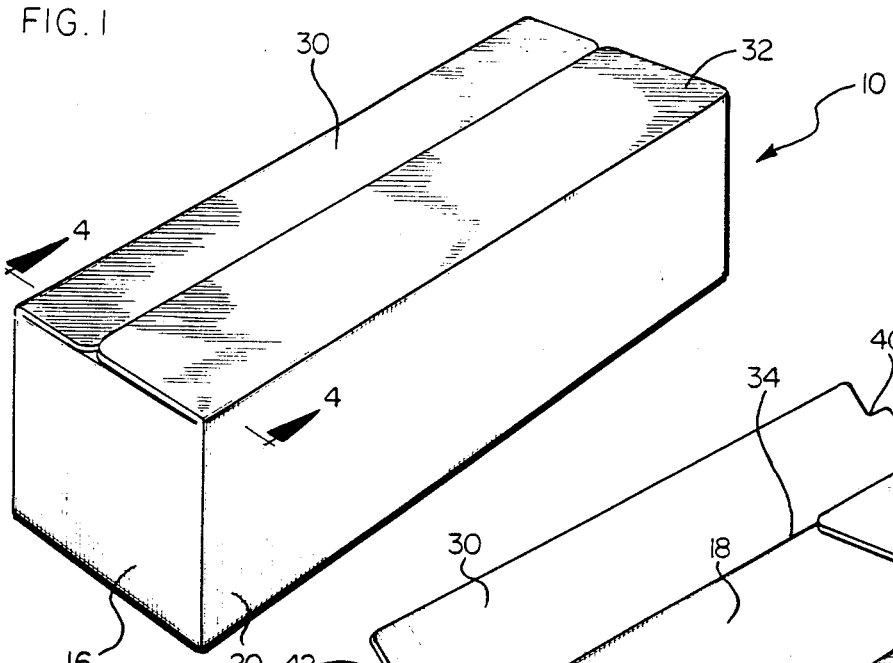
FIG. 1 is a top perspective view of a carton exemplary of the invention, illustrating the carton when closed.

Referring now to the drawings, there is illustrated a carton 10 exemplary of the invention, which carton includes a bottom wall 12, a pair of end walls 14 and 16, a pair of side walls 18 and 20, a pair of end flaps 22 and 24, and a pair of side flaps 30 and 32. The carton 10 preferrably is cut and scored from a blank of sheet material such as corrugated cardboard and subsequently glued and folded to form the carton 10 in the conventional fashion. The end flaps 22 and 24 are integrally affixed to the end walls 14 and 16 along the top edges thereof and are foldable along the score lines 26 and 28 to at least partially overlie the opened top of the carbon 10 as illustrated. Correspondingly, the side flaps 30 and 32 are integrally affixed to the upper edges of the side walls 18 and 20 and are foldable along the score lines 34 and 36 to overlap the end flaps 22 and 24 and to overlap one another to close the opened top of the carton 10.

As indicated above, in order to recloseably seal the carton 10, complimentary fastening means 38*a* and 38*b* are secured to the end flaps 22 and 24 and to the one side flap 32 and positioned so that when the side flap 32 is folded along the score line 36 to overlie the end flaps 22 and 24, the complimentary fastening 38*a* and 38*b* releasably lockingly engage one another.

Figure 2:
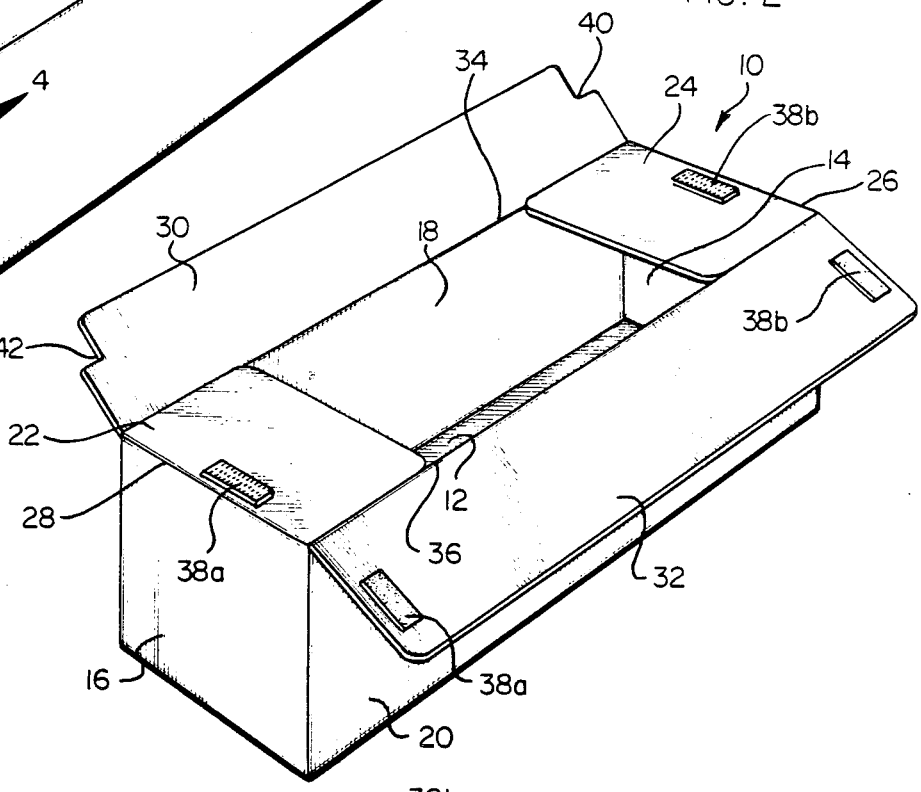
FIG. 2 is a top perspective view of the carton of FIG. 1, with the end flaps thereof illustrated in their closed position atop the open end of the carton and with the side flaps thereof opened.
Figure 3:
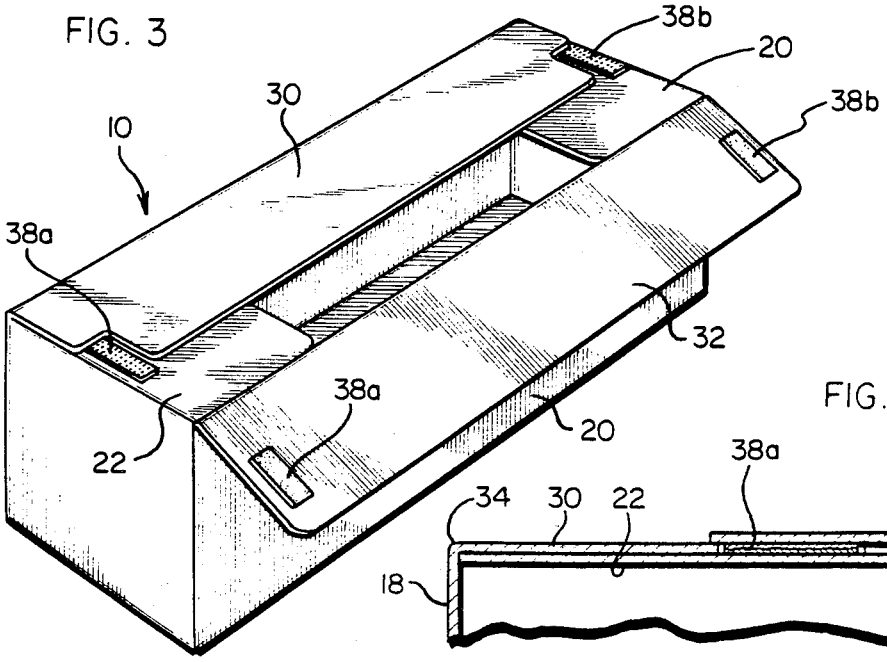
FIG. 3 is a top perspective view of the carton of FIGS. 1 and 2, illustrating one side flap thereof folded to overlie the opened top of the carton atop the folded end flaps.
Figure 4:
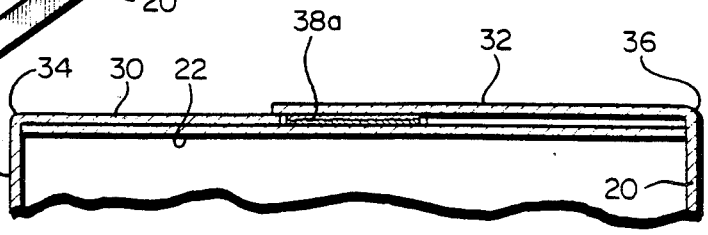
FIG. 4 is a sectional view taken generally along lines 4—4 of FIG. 1, to illustrate the manner in which the side flaps overlap and relieve the pressure which may be exerted on the fasteners.

In closing the carton 10, the end flaps 22 and 24 first are folded to overlie the opened top of the carton, the side flap 30 folded over to overlie the end flaps 22 and 24, and then the side flap 32 folded to overlie the side flap 30, as illustrated in FIG. 4, to seal the opened top of the carton 10. As can be best seen in FIGS. 2 and 3, the side flap 30 is cut away at its corners 40 and 42, as illustrated, so that the fasteners 38*a* and 38*b* affixed to the end flaps 22 and 24 are exposed when the side flap 30 is folded in overlapping relationship atop the end flaps 22 and 24, as illustrated in FIG. 3. Accordingly, when the side flap 32 then is folded over to overlap the side flap 30, the fasteners 38*a* and 38*b* lockingly engage with one another. As described above, affixing the fasteners 38*a* and 38*b* to the end flaps 22 and 24 and the side flap 32 and forming the side flap 30 so that the fasteners 38*a* and 38*b* lockingly engage when the side flaps 30, 32 are folded in overlapping relationship provides several advantages. Included among these adventages are the fact that the cartons can be more easily stacked, without damage to them, and that the pressure exerted on the fasteners 38*a* and 38*b* is relieved so that they are not destroyed due to being crushed when the cartons are stacked atop one another and further can be more easily disengaged, all as more particularly described below.

In opening the carton 10, it is preferred that the side flap 32 be gripped along its free edge at an area approximate the center thereof equal distance between the opposite longitudinal edges thereof and an upward force slowly exerted on the side flap 32. In doing so, the side flap 32 bows slightly so that an outwardly expanding force is applied across the fasteners 38*a* and 38*b* to effectively peel the complimentary halves thereof apart to disengage the fasteners so that the side flap 32 can be reversely folded along the score line 36 to open the carton 10. To reclose the carton 10, the end flaps 22 and 24 and the side flaps 30 and 32 are simply refolded in the manner described above, to again engage the complimentary fasteners 38*a* and 38*b* to close and to seal the carton 10.

As illustrated, the complimentary fasteners 38*a* and 38*b* are located adjacent the edges of the end flaps 22 and 24 and the side flap 32. The location is critical only to the extent that the fasteners should be located near the score lines 26 and 28 so as to reduce the tendency of the end flaps 22 and 24 to fold down inside the carton 10 when the carton is empty or only partially filled, so that the complimentary fasteners 38*a* and 38*b* will lockingly engage when the side flap 32 is folded over atop of them. Of course, the side flap 30 must be formed so that the complimentary portion of the fasteners 38*a* and 38*b* are exposed when the side flap 30 is folded over to overlay the end flaps 22 and 24. Also, while it is preferred to use VELCRO fasteners, other complimentary type fasteners such as, for example, snaps fasteners could be used.

Figure 5:
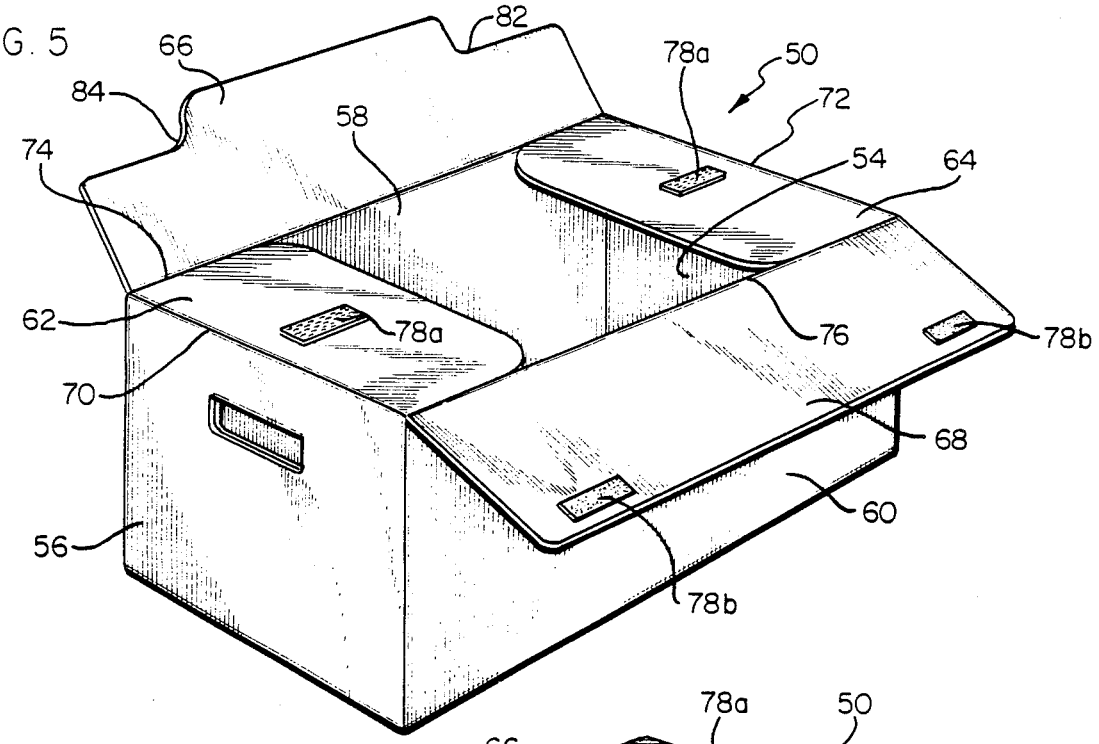
FIG. 5 is a top perspective view of the carton, with the fasteners secured thereto in accordance with another embodiment of the invention and with the end flaps thereof illustrated in their closed postion atop the open end of the carton and with the side flaps thereof opened.
Figure 6:
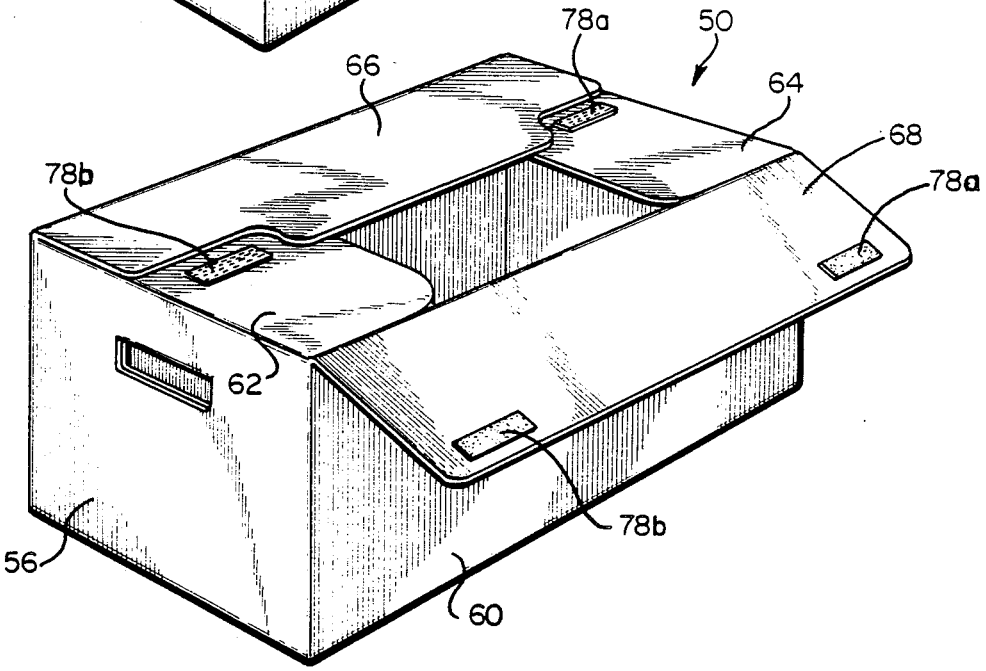
FIG. 6 is a top perspective view of the carton of FIG. 5, illustrating one side flap thereof folded to overlie the opened top of the carton atop the folded end flaps.
Figure 7:
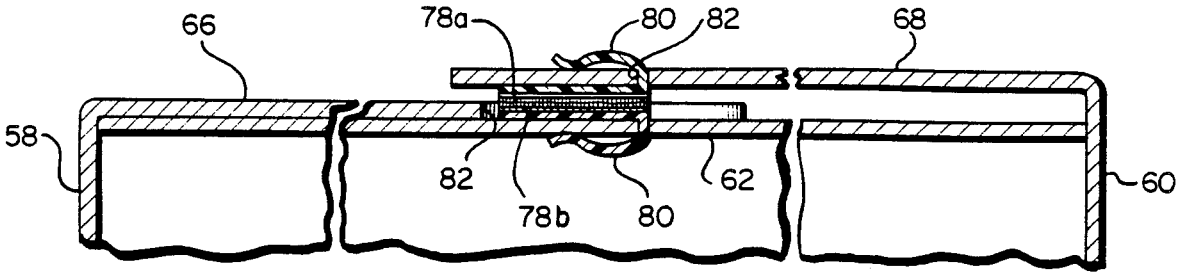
FIG. 7 is a sectional view illustrating the manner in which the flaps overlap and engage the fastening means.

In FIGS. 5–7 there is illustrated another carton 50 exemplary of another embodiment of the invention, which carton includes a bottom wall (not shown), a pair of end walls 54 and 56, a pair of side walls 58 and 60, a pair of end flaps 62 and 64, and a pair of side flaps 66 and 68. The carton 50 like the carton 10 preferrably is cut and scored from a blank of sheet material such as corrugated cardboard and subsequently glued and folded to form the carton 50 in the conventional fashion. The end flaps 62 and 64 are integrally affixed to the end walls 54 and 56 along the top edges thereof and are foldable along the score lines 70 and 72 to at least partially overlie the opened top of the carton 50 as illustrated. Correspondingly, the side flaps 66 and 68 are integrally affixed to the upper edges of the side walls 58 and 60 and are foldable along the score lines 74 and 76 to overlap the end flaps 62 and 64 and to overlap one another to close the opened top of the carton 50.

In this case, the complimentary fastening means 78*a* and 78*b* are secured to clips 80 which are of a generally u-shaped configuration, and the clips 80 are slidably disposed in and through slots 82 formed in the respective ones of the end flaps 62, 64 and the slide flap 68. In this case also, the fastening means 78*a* and 78*b* are positioned so that the side flap 68 is folded along the score line 76 to overlie the end flaps 60 and 62, the complimentary fastening means 78*a* and 78*b* releasably lockingly engage one another.

It has been found that adhesively securing the complimentary fastening means to cartons which are intended to be repeated opened and closed, as in the case of the disclosed cartons, may not provide a sufficient bond between the fastening means and the carton and that the fastening means may become detached from the carton. This is particularly true if the carton is used for an extended period of time. The adhesive securing the fastening means to the carton reacts with the adhesive securing the corrugated paperboard together and can cause the layers of corrugated paperboard material to separate and to thus permit the fastening means and the layer of corrugated paperboard material to tear lose from the carton. Accordingly, to prevent this from happening, the fastening means preferrable and advantageously are secured to the clips, and secured by the clips to the carton.

As in the case of the carton 10, in closing the carton 50, the end flaps 62 and 64 first are folded to overlie the opened top of the carton, the side flap 66 folded over to overlie the end flaps 62 and 64 and then the side flap 68 folded to overlie the side flap 66 as illustrated in FIG. 7, to seal the opened top of the carton 50. In this case also, as can be best seen in FIGS. 5 and 6, the side flap 66 is cut away at its corners 82 and 84 as illustrated, so that the fasteners 78*a* and 78*b* affixed to the end flaps 62 and 64 are exposed when the side flap 66 is folded in overlapping relationship atop the end flaps 62 and 64 as illustrated in FIG. 6. Accordingly, when the side flap 68 then is folded over to overlap the side flap 66 the fasteners 78*a* and 78*b* lockingly engage with one another. Again, affixing the fastening means 78*a* and 78*b* to the end flaps 62 and 64 and the side flap 68 and forming the side flap 66 so that the fasteners 78*a* and 78*b* lockingly engage when the side flaps 66, 68 are folded in overlapping relationship provides the same advantages as described aboe. The carton 50 is opened in the same fashion described above, in the case of the carton 10.

Accordingly, from the above description it can be seen that an improved transfer storage cartons 10 and 50 are provided which can be easily opened and re-closed without mutilating the carton in any way. The cartons 10 and 50 are of a conventional construction and can be formed and shipped in a knock-down configuration as most such type carton presently are shipped, with the cartons all stacked one atop the other. The fasteners on the respective cartons do not contact one another since the fasteners all are on one side of the stacked cartons and contact the opposite side which is free of any fasteners of the carton stacked atop of it, thus fasteners on the respective ones of the stacked cartons cannot inadvertantly lockingly engage one another. The individual ones of the cartons therefore can be easily removed from the stack. Also, both fasteners are substantially simultaneously peeled apart to separate them to open the carton when the side flap 30 is raised, hence there is no danger that one fastener may be inadvertantly torn from the carton through neglect of the party opening the carton neglecting to release one fastener, as in the case of the string-type fasteners presently used.

What is claimed is:

1. A carton for storing articles such as correspondence files and the like, the carton being normally sealed and closed to protect articles stored therein and being adapted to be periodically opened without damage to the carton and subsequently re-sealed to again close the carton, comprising:

a bottom wall and four side walls integrally formed to provide an open compartment for receiving therein said articles;

a pair of end flaps, each of which is integrally formed with an upper edge of one of said side walls which are opposed to one another and foldable along said upper edges to at least partially overlie the top of said open compartment;

a first and a second side flap each of which is integrally formed with an upper edge of one of said side walls which are opposed to one another and foldable along said upper edges to overlie said pair of end flaps when the latter are folded to overlie the top of said open compartment, said second side flap being proportioned to at least partially overlap said first side flap to seal and close the top of said open compartment;

complimentary fastening means which are adapted to engage and disengage with one another fixedly secured to each of said end flaps and to at least one of said side flaps, said complimentary fastening means being affixed to each of said end flaps in a position where said complimentary fastening means normally would be overlapped by said first side flap when the latter is folded to overlie said end flaps and said first side flap being formed with portions thereof cut away such that said complimentary fastening means affixed to each of said end flaps is exposed when said first side flap is folded to overlie said end flaps, said complimentary fastening means being affixed to said second side flap in positions to engage with said complimentary fastening means affixed to said end flaps when said second side flap is folded to overlap said end flaps and said first side flap to thereby secure said end and side flaps together to seal the top of said open compartment, said complimentary fastening means being automatically disengaged with one another to permit said end and side flaps to be folded to open the top of said open compartment simply by exerting an upward force to said second side flap and subsequently automatically engaged with one another to close the top of said open compartment simply by exerting a downward force to said second side flap.

2. The carton of claim 1, wherein said end flaps and said one side flap have slots formed in them, and wherein said complimentary fastening means are fixedly secured to u-shaped clips, said clips being extended through said slots to fixedly secure said fastening means to said end flaps and said one side flap.

* * * * *